US007252102B1

(12) United States Patent
Grass et al.

(10) Patent No.: US 7,252,102 B1
(45) Date of Patent: Aug. 7, 2007

(54) ULTRASONIC SLAT WASHER

(76) Inventors: Jeff Grass, 328 18th St., Manhattan Beach, CA (US) 90266; Michael Giboney, 3291 Oink Cedar Ct., Simi Valley, CA (US) 93065

( * ) Notice: Subject to any disclaimer, the term of this patent is extended or adjusted under 35 U.S.C. 154(b) by 559 days.

(21) Appl. No.: 10/633,129

(22) Filed: Aug. 1, 2003

(51) Int. Cl.
*B08B 3/12* (2006.01)

(52) U.S. Cl. ..... 134/184; 134/84; 134/85; 134/92; 134/147; 134/148; 134/157; 134/198; 134/201

(58) Field of Classification Search ..... 134/84, 134/92, 184, 85, 147, 148, 157, 198, 201
See application file for complete search history.

(56) References Cited

U.S. PATENT DOCUMENTS

| | | | | |
|---|---|---|---|---|
| 3,135,274 | A * | 6/1964 | Baldwin et al. | 134/147 |
| 3,503,805 | A * | 3/1970 | Denyes | 134/1 |
| 4,114,194 | A | 9/1978 | Walter | 366/111 |
| 4,185,734 | A | 1/1980 | Bross | 198/484 |
| 4,320,528 | A | 3/1982 | Scharton et al. | 376/310 |
| 4,442,852 | A | 4/1984 | Lord | 134/135 |
| 4,677,283 | A | 6/1987 | Lewis | 235/98 |
| D315,039 | S | 2/1991 | Wortham | D32/1 |
| 5,109,174 | A | 4/1992 | Shewell | 310/317 |
| 5,191,741 | A | 3/1993 | Jones | 53/475 |
| 6,259,653 | B1 | 7/2001 | Courson et al. | 367/141 |

FOREIGN PATENT DOCUMENTS

JP 54089604 * 7/1979

JP 57027404 * 2/1982

OTHER PUBLICATIONS

Web page regarding slat sets and other machined parts, 1 page, from the www.ipsnj.com website; dated Apr. 3, 2003.

Web page from Universal Machine Company re slat washer, 2 pages, from the http://216.239.37.100/search?q=cache:5kEhuliGGjsC:www.umc-oscar.com website; dated Apr. 3, 2003.

Web page regarding electronic counting speeds changeover, 8 pages, from the www.packagingdigest.com website; dated Apr. 3, 2003.

Web page regarding Industrial Applications for Ultrasonics Cleaners with a sub-category title "Window Blind Cleaning Solutions" and the Model Sonic Pro 8000B, 2 pages, from the www.sonicpro.com website; dated Apr. 21, 2003.

* cited by examiner

*Primary Examiner*—M. Kornakov
(74) *Attorney, Agent, or Firm*—Cislo & Thomas LLP

(57) ABSTRACT

An ultrasonic cleaner apparatus is disclosed which includes a support housing, a tub supported by the housing and an ultrasound and sensor transducer contacting the bottom of the cleaning tank. A fixture assembly for holding items to be cleaned is configured for insertion into the cleaning tank. The fixture assembly comprises a predetermined number of slots, which are positioned around the perimeter of a pair of end disks disposed on the fixture assembly. The slots are configured to receive the distal ends of slats or other items to be cleaned. Rotation of the fixture assembly in the cleaning solution and ultrasonic energy effectively cleans the items while the fixture assembly securely holds the items during cleaning, rinsing and drying.

15 Claims, 8 Drawing Sheets

ULTRASONIC SLAT WASHER

BACKGROUND OF THE INVENTION

1. Field of the Invention

This invention relates to a washing device, system and method for cleaning slats used in slat-type counting machines adapted for small, discrete particles such as pharmaceutical and nutritional tablets, capsules and caplets.

2. Description of the Related Art

There are many devices on the market today for counting capsules and tablets into containers such as bottles or boxes. One of the fastest types of tablet counters on the market today is a slat counter wherein slats are fitted onto a moving belt rotating through a hopper containing tablets or capsules. The slats have a predetermined number of holes, each of which are filled with a capsule or tablet from the hopper. As each slat moves to the unloading position, a predetermined number of tablets or capsules are directed into a container.

One type of slat counter is a continuous slat counter, which typically comprises a moving bed with a series of grooved slats that pass beneath a quantity of tablets. The grooves are further subdivided into cavities and one tablet is permitted to drop into each cavity until all the cavities are filled. After the filled slats move from beneath the stationary quantity of tablets, they are inverted and the tablets fall out and are collated and fed into containers via transport through a manifold system.

Another version of a continuous slat-type counting and filling machine is disclosed in U.S. Pat. No. 3,925,960, in which the slats and cavities are oriented horizontally, i.e., coaxial with the axis around which they are moving. A series of chutes collects the counted tablets and delivers them to a moving series of containers. Yet another variation of slat counting machines is disclosed in U.S. Pat. No. 4,674,259, in which the slats are vertically-oriented cavities that deliver the counted product to a series of chutes that shuttle alternately between a first and a second row of containers.

While slat-type counting devices provide high speed counting, their advantages become limited when the product enclosed in the capsules changes or when the quantity or size of the capsules to be packaged changes. If any of these parameters are altered, every slat has to be cleaned before it can be re-configured for the new product, which requires considerable down time.

The cleaning process presents a number of difficulties due to the size and configuration of typical slats. Historically, the slats used in counting devices are made from a FDA approved material, such as Delrin®, and have a row of cavities drilled into them to hold the tablets or capsules. Therefore, the cleaning process requires the precision of small parts cleaning in that small particles will need to be removed from small crevice-like openings and indentations. The cleaning process must also be on an industrial scale because the slats are typically fairly large items that must be cleaned in large quantities in industrial packaging settings. Typically, however, slats are taken to a maintenance area within a manufacturing facility and washed manually with, for example, tap water from a hose, and air-dried. The present invention discloses an apparatus and method for cleaning slats, which permits more thorough and efficient cleaning of slats, which is suited to industrial packaging settings.

SUMMARY OF THE INVENTION

The present invention generally comprises a housing, support frame, a tub for containing cleaning fluid, a carousal-like fixture assembly, and an ultrasound unit comprising an ultrasonic transducer and sensor, and the slats or other items to be cleaned. The fixture assembly is mounted onto a rotating shaft disposed inside the housing and is adjustable to accommodate slats or other items of different lengths or sizes. The slats or other items can be loaded one-by-one onto the fixture assembly while the fixture assembly is engaged within the housing, or the fixture assembly can be removed, loaded and placed back in the housing. The fixture assembly is configured to securely hold the slats in place while cleaning, and preferably rotates 360 degrees for a predetermined amount of time or rotations. Ultrasonic transducers supply energy to clean the slats or other items and are preferably disposed on the bottom of the tub inside the housing. The fixture assembly holds the slats or other items in a secured position, even when energy from the ultrasonic transducer is supplied to the slat washer during the wash cycle.

During the wash cycle, the tub fills with cleaning liquid, the fixture assembly rotates 360 degrees, and the slats are introduced into and out of the vibrating cleaning liquid for a predetermined amount of time or rotations of the fixture assembly.

The cleaning liquid is then drained from the tub by gravity. During a primary rinse cycle, nozzles disposed in the housing spray pressurized rinse liquid onto the slats, again, for a predetermined amount of time or rotations. During the rinse cycle the gravity drains remain open to remove the water from the bottom of the tub. Once the cleaning liquid is drained from the primary rinse cycle, an optional purified rinse cycle using United States Pharmacopeia ("USP") water can be performed.

Next, during the drying cycle, the rotating items or slats are dried by nozzles, which emit warm air for a predetermined amount of time or rotations. Once the appropriate wash and dry cycles have been completed, the items or slats can be removed one-by-one from the enclosure or the entire fixture assembly can be removed with all the items intact and brought directly to the slat counter or other device for re-loading the slats or other items.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention. References herein to right/left, upper/lower, first/second and the like are intended for clarification and are relative and interchangeable.

Figure 1:
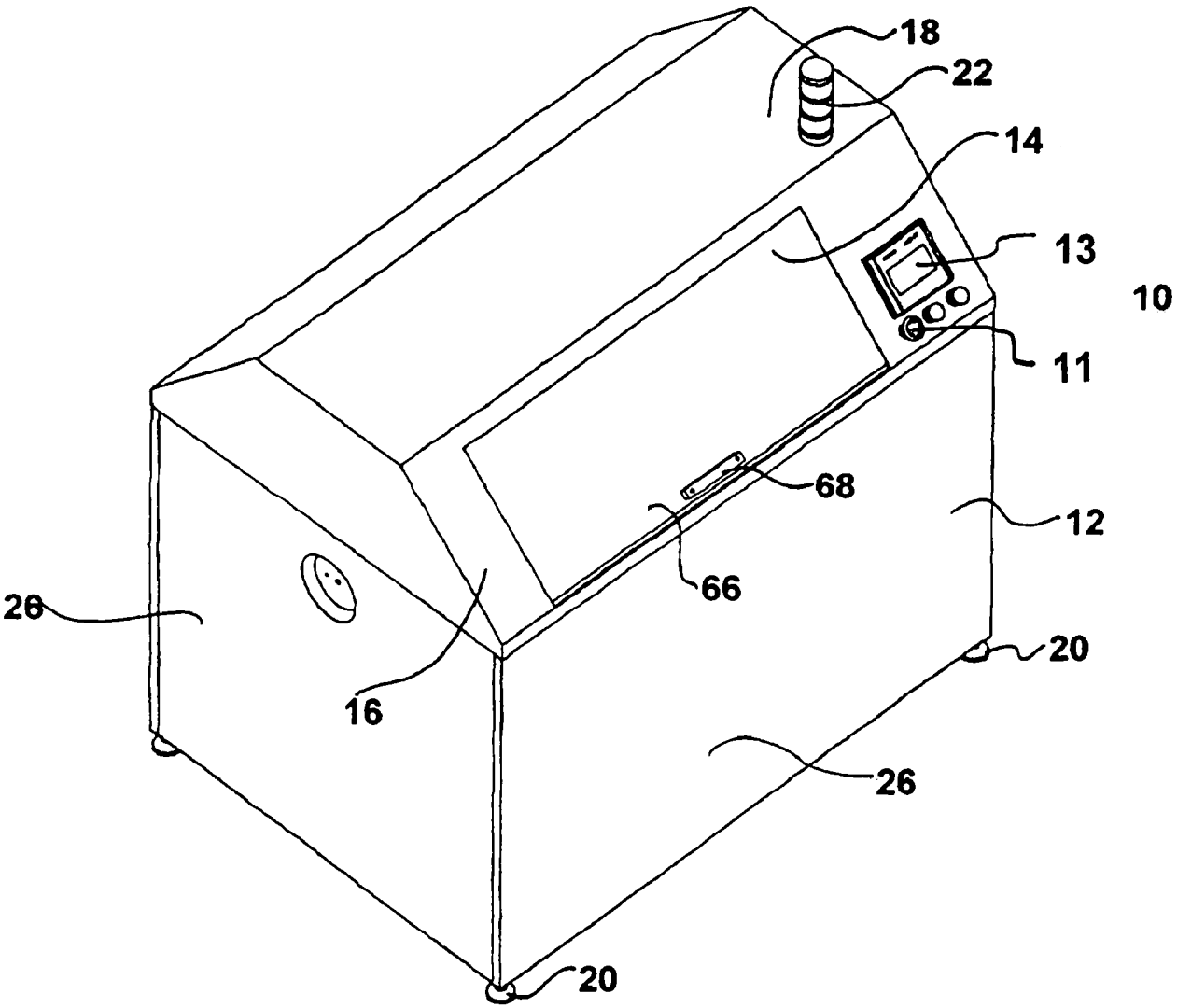
FIG. 1 is a perspective front view of the slat washer housing and an operating interface panel.

Referring now to the drawings, and in particular, to FIG. 1, the slat washer according to the present invention is generally referred to by reference numeral 10. The ultrasonic slat washer 10 comprises a housing 12 with an access port 14 of predetermined size, preferably disposed on a down-sloping side 16 of the housing top or cover 18 for easy access by the operator. The access port 14 preferably comprises a lid 66 with a handle 68 projecting upwardly from the lid 66. The housing 12 may be supported on four support feet 20, or on wheels (not shown) for mobility. The housing cover 18 comprises an air inlet 22 to permit movement of warm air used for drying the slats within the housing 12. The housing 12 may comprise durable panels 26, such as stainless steel panels, that engage with a support frame 28 (FIG. 2) to define the housing.

Figure 2:
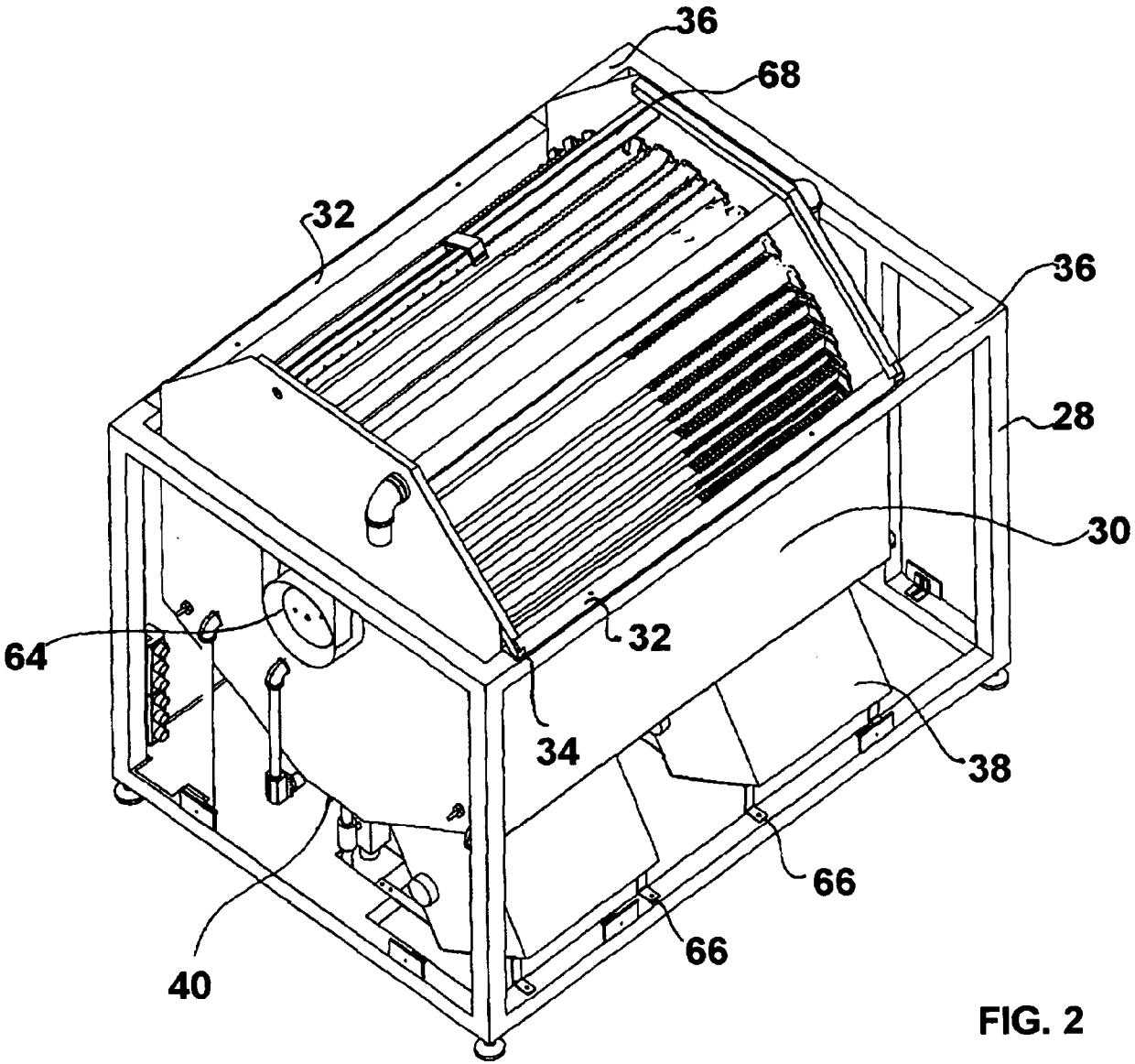
FIG. 2 is a perspective of the internal mechanical components of the machine without the housing.
Figure 3:
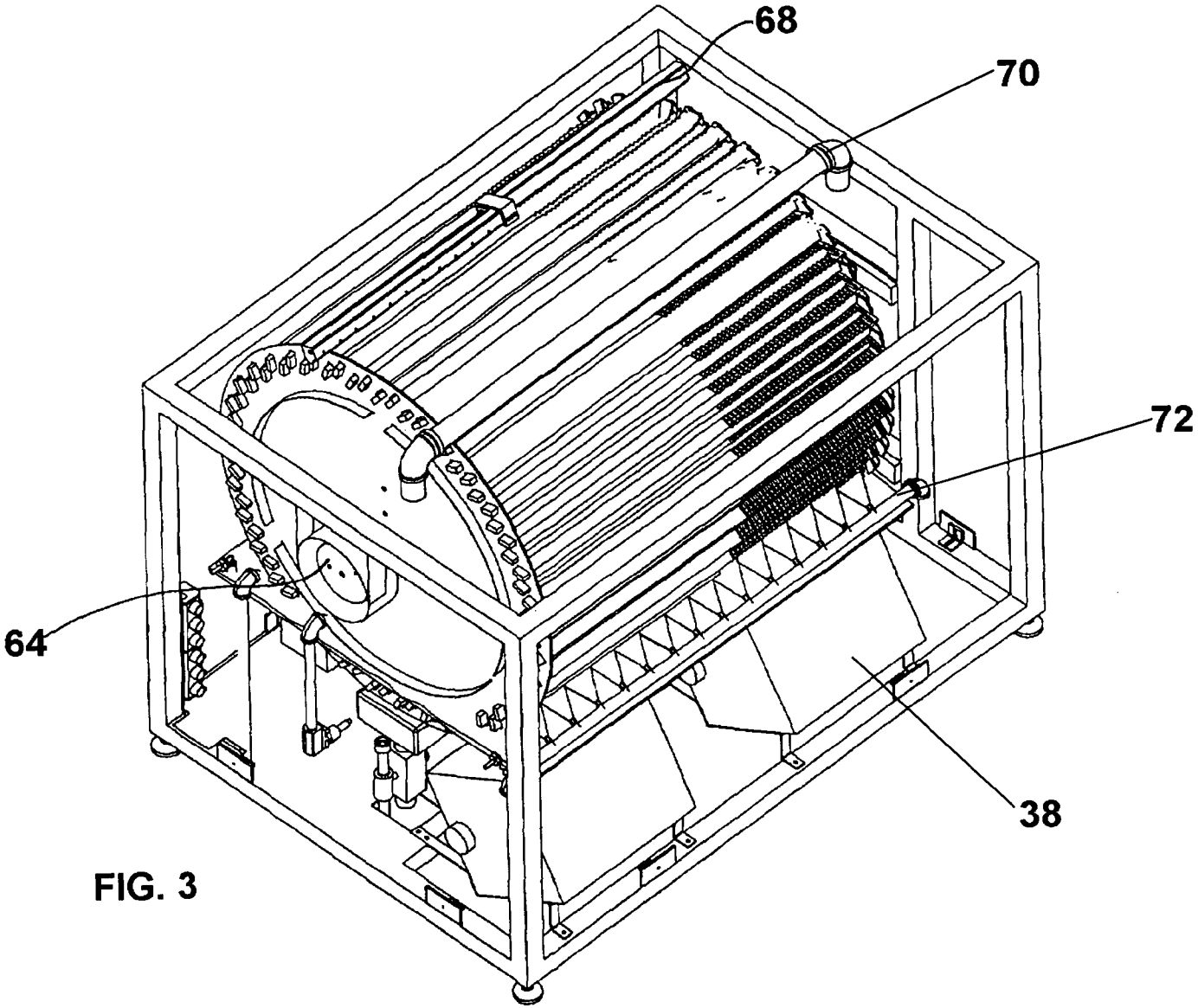
FIG. 3 is a perspective of the fixture mounted within the housing.
Figure 4:
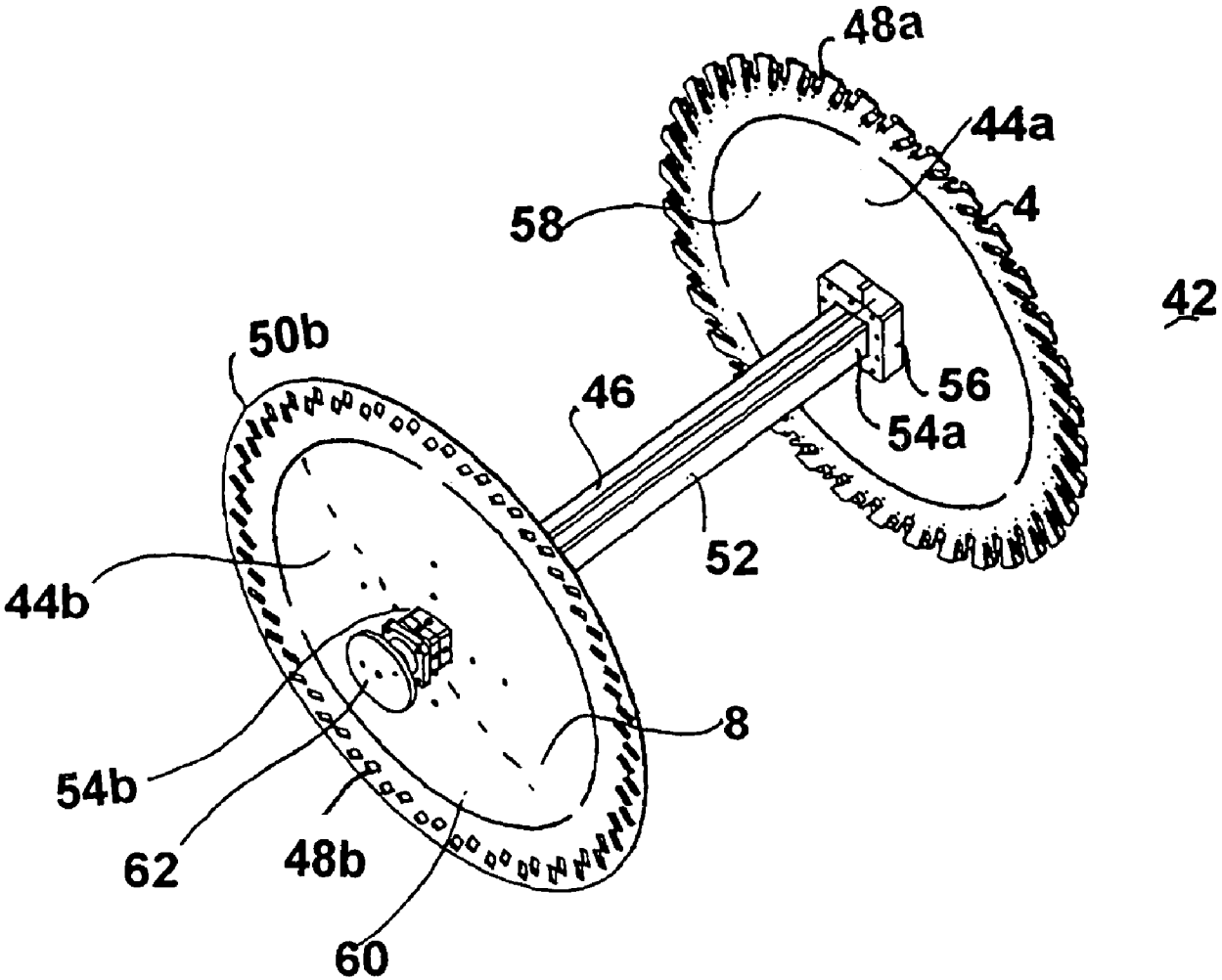
FIG. 4 is a perspective of the fixture assembly.
Figure 5:
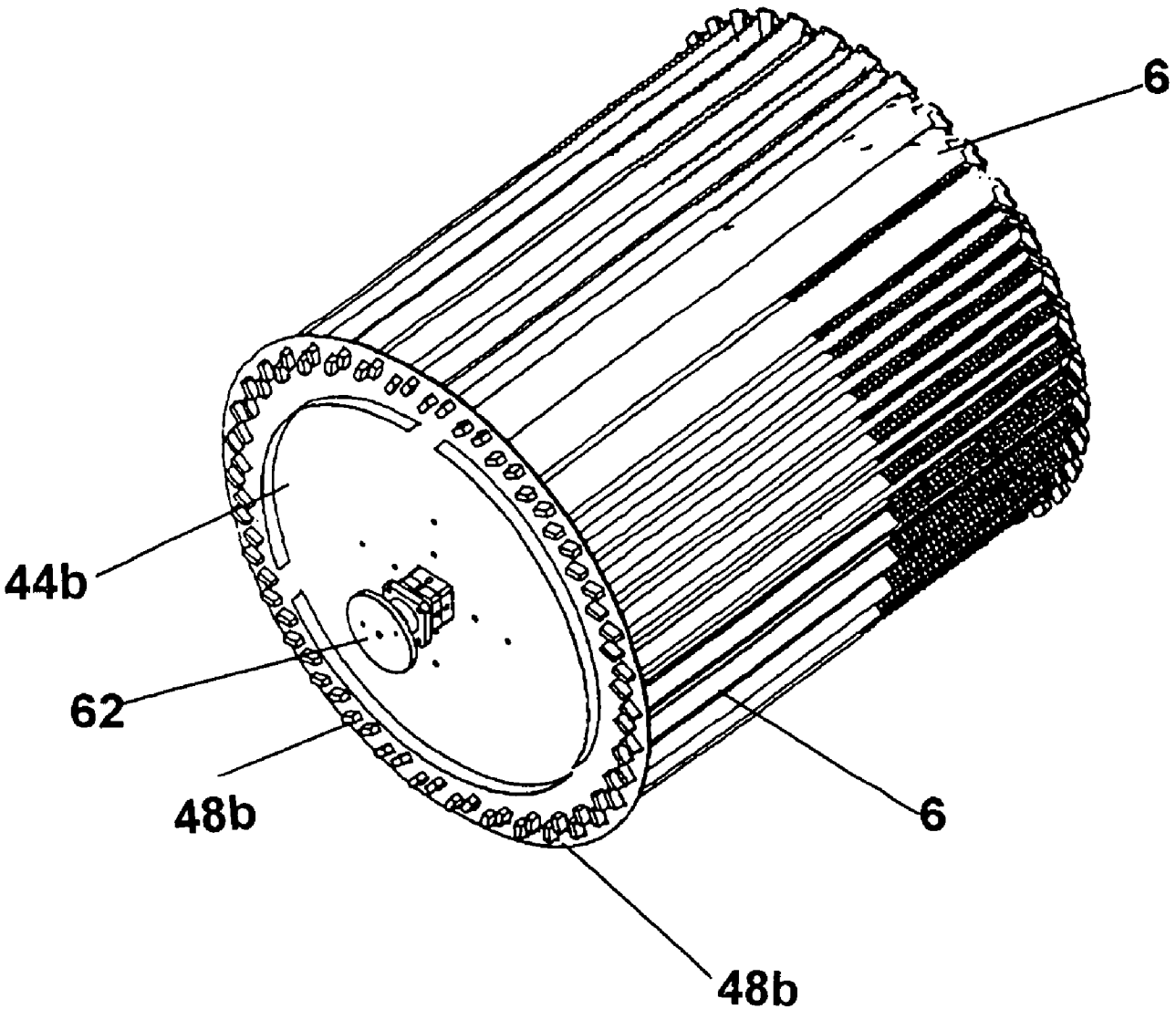
FIG. 5 is a perspective of the fixture assembly with slats held intact.
Figure 6:
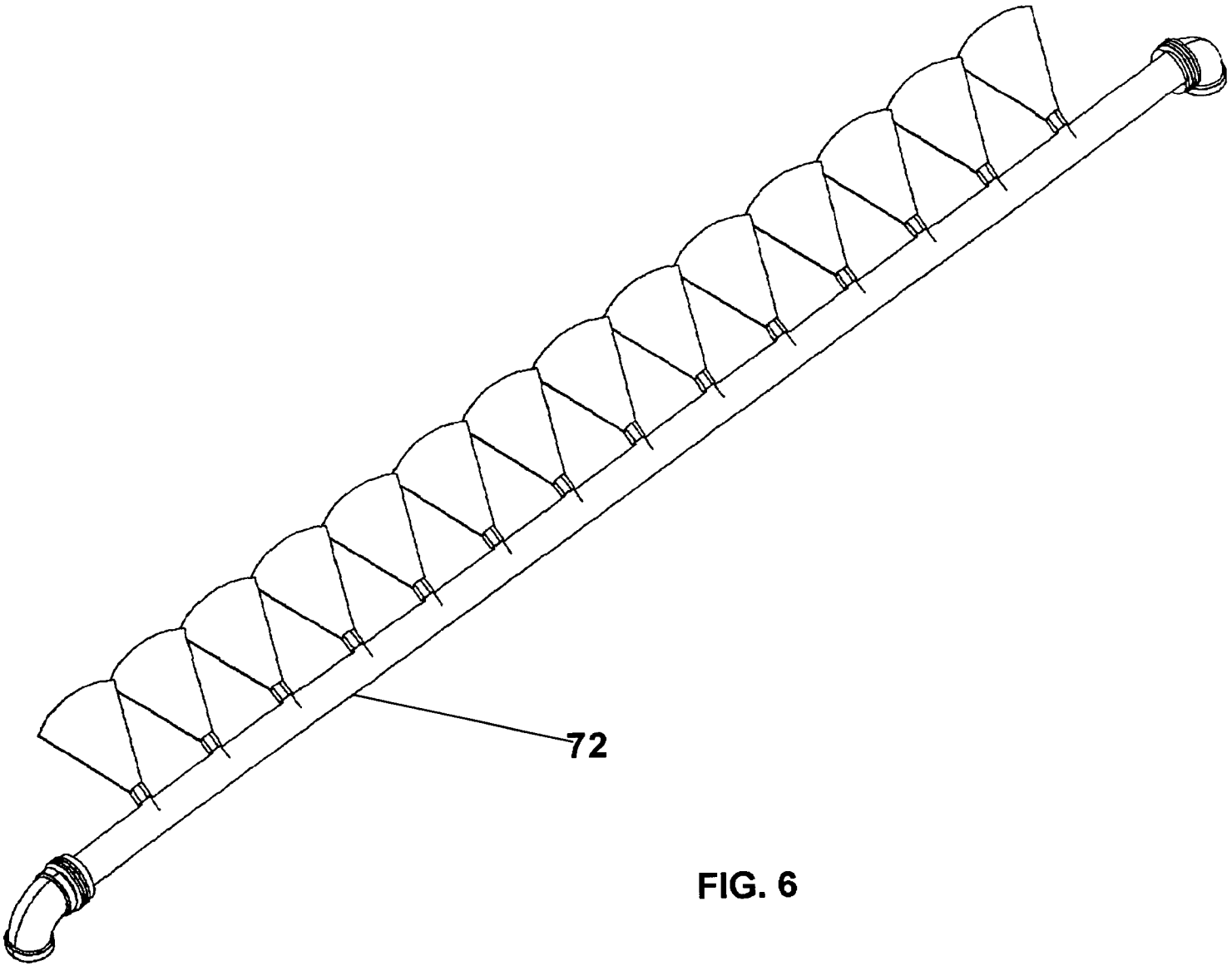
FIG. 6 is a perspective of the rinse water system.
Figure 7:
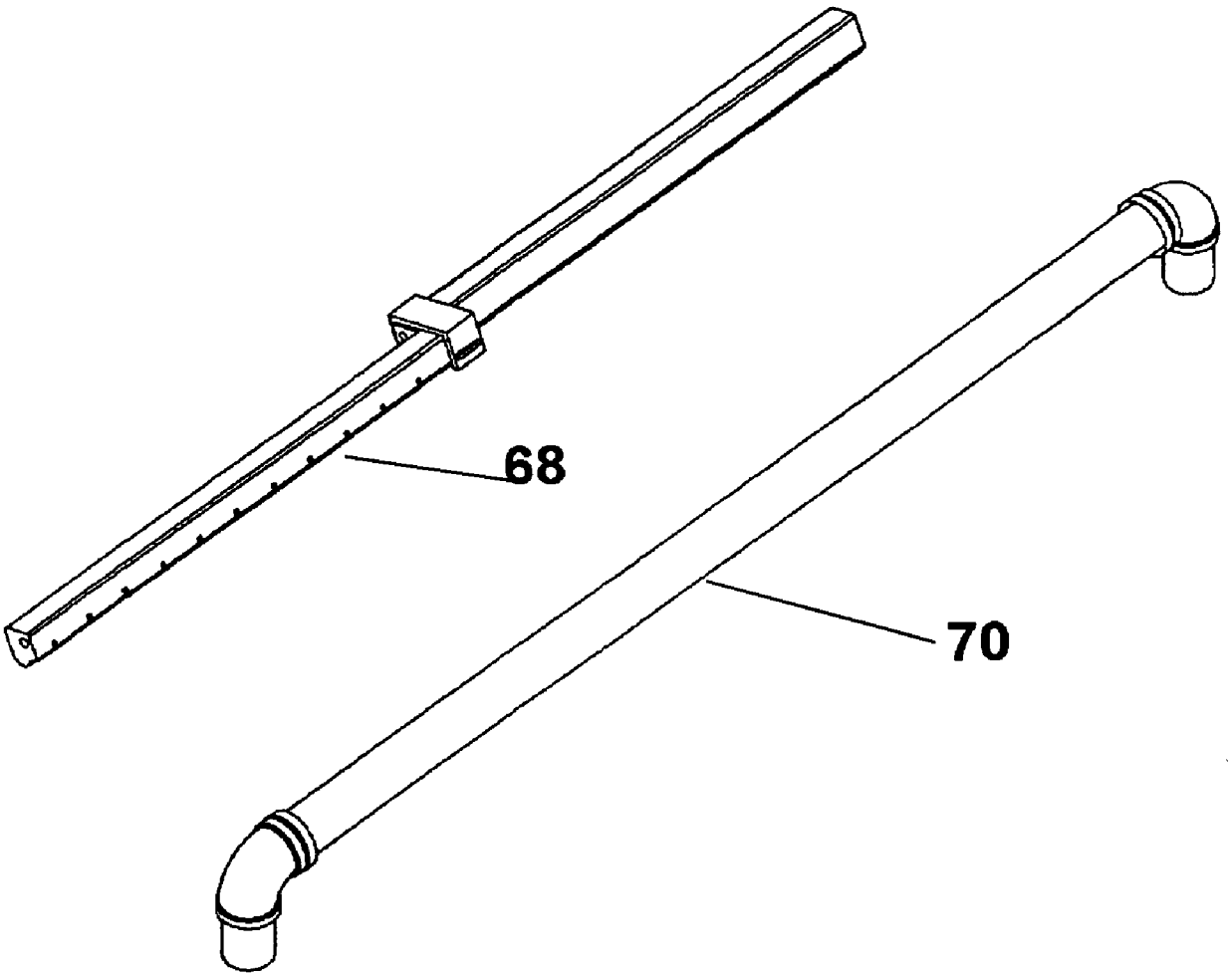
FIG. 7 is a perspective of the forced warm air system.

A tub 30 is configured to fit within the housing 12. The tub 30 is preferably configured with rounded or octagonal walls and may be secured within the housing 12 by outward extending flanges 32, tabs 34, or a combination thereof (as shown in FIG. 2), which seat the tub 30 against a stable portion of the housing 12, or preferably against upper elements 36 of the support frame 28. The tub 30 can be securely affixed to the housing 12 or support frame 28 using conventional means known in the art, such as bolts, screws or weld points. In the preferred embodiment, the tub 30 has rounded sides and an open top and is formed of stainless steel. An ultrasound unit 38, comprising an ultrasound transducer and sensor, preferably engages the bottom 40 of the tub 30. An engagement means 66 secures the ultrasound unit 38 to the support frame 28, tub 30, or housing 12. The ultrasound unit 38 is connected by a cable (not shown) to an electronic power means (not shown) for supplying power to the ultrasound unit 38. The engagement means 66 may comprise tabs or metal flanges that are bolted or welded to the support frame 28, housing 12 or tub 30 to secure the ultrasound unit to the slat washer 10. Alternately, the ultrasound unit 38 may be attained to the slat washer 10 using suitable means known in the art, such as welding, adhesives, bolts or brackets.

In the preferred embodiment, forced air nozzles 68 are linearly arranged along an airflow assembly 70 that is disposed above the upper surface of a fixture assembly 42, and may be releasably secured to the tub 30, support frame 28 or housing 12. The slat washer 10 may also be configured to operate without an airflow assembly or forced air nozzles. A rinse water unit 72 is preferably disposed inside the tub 30, adjacent its lower end 40 and is preferably configured to be spaced from the lower end of the fixture assembly 42 when it is correctly seated in the tub 30.

With reference to FIGS. 3-5 and FIG. 8, the fixture assembly 42 is preferably cylindrical in overall shape and comprises a first and a second end disk 44*a*, 44*b* spaced apart by a shaft 46. The end disks 44*a*, 44*b* comprise a plurality of slots 48*a*, 48*b* along their respective perimeters 50*a*, 50*b*. The slots 48*a* on the first end disk 44*a* preferably align with slots 48*b* on the second end disk 44*b* when the end disks 44*a*, 44*b* are properly seated on the shaft 46. The slots 48*a*, 48*b* are configured to receive the distal ends 90*a*, 90*b* of individual slats 6 therein to secure the slats 6 on the fixture assembly 42.

In the preferred embodiment, the slots 48*a* on the first end disk 44*a* comprise an open side 4 and the slots 48*b* on the second end disk 44*b* comprise four closed sides 94. In the preferred embodiment, the slots 48*a*, 48*b* are angled from a center axis 8 of each respective end disk 44*a*, 44*b* so that the slats 6 can be securely seated on the fixture assembly 42 and will remain securely held, even when subject to vibrations from the ultrasound unit 38. In the preferred embodiment, the slots 48*a*, 48*b* are disposed at an approximately 30 to 60 degree angle from the center axis 8 of the respective end disks 44*a*, 44*b*. Preferably, the slats 6 are loaded onto the fixture assembly 42 by slipping one slot end 90*b* in the slots 48*b* of the second end disk 44*b* and an opposite slot ends 90*a* into the open side 4 of the slots 48*a* on the first end disk 44*a*. The open side 4 of each slot 48*a* on the first end disk 44*a* comprises a tab or hook element 2 (FIG. 8) to assist in securing each slat 6 on the fixture assembly 42, even when the ultrasound unit 38 is in operation or when the fixture assembly 42 rotates.

In the preferred embodiment, the hook element 2 comprises a substantially rectangular shape that approximates the dimensions of the slot 48*b* and comprises a top 76, a bottom section 78, two flat sides 80, a front side 82*a* and a rear side 82*b*. The hook element 2, however, may be of other suitable shapes and dimensions. In the preferred embodiment, the top 76 of the hook element 2 is angled slightly towards either the right or left. A center indentation 86 in the hook element 2 defines a tab 84 adjacent the top 76 of the hook element 2 and the bottom section 78 of the hook element 2. In the preferred embodiment, the hook element 2 is adjustably attached at one of the closed sides 94 of the open-ended slots 48*a*. The hook element 2, however, may also be fixed to the end disk 44*a* or placed in other suitable locations in relation to the slots 48*a*. Alternately, the slats 6 may be seated on the fixture assembly without the use of the hook element 2.

In the preferred embodiment, one end 90*a* of an individual slat 6 is seated on one of the end disks 44*a* and the opposite end 90*b* of the slat 6 is adjustably but securely seated in a slot 48 on the opposite end disk 44*b* by fitting the end 90*b* of the slat 6 in the center indentation 82 disposed in the hook element 2. In the preferred embodiment, the closed and open slot 48*b*, 48*a* arrangement and hook element 2 provides adjustable and secure placement of different size slats 6 onto the fixture assembly 42 for cleaning in the slat washer 10. The fixture assembly 42, however, may also comprise end disks 44*a*, 44*b* having alternate slot arrangements, such as all closed 48*b* or open 48*a* slots, on each end disk 44*a*, 44*b*. Alternately, each end disk 44*a*, 44*b* may comprise a combination of open-ended and closed slots 48*a*, 48*b* so that aligned slots 48*a*, 48*b* on opposite end disks 44*a*, 44*b* comprise one closed end slot 48*b* and one open-end slot 48*a*. For example, open and closed slots 48*a*, 48*b* may alternate on each end disk 44*a*, 44*b*.

Figure 8:
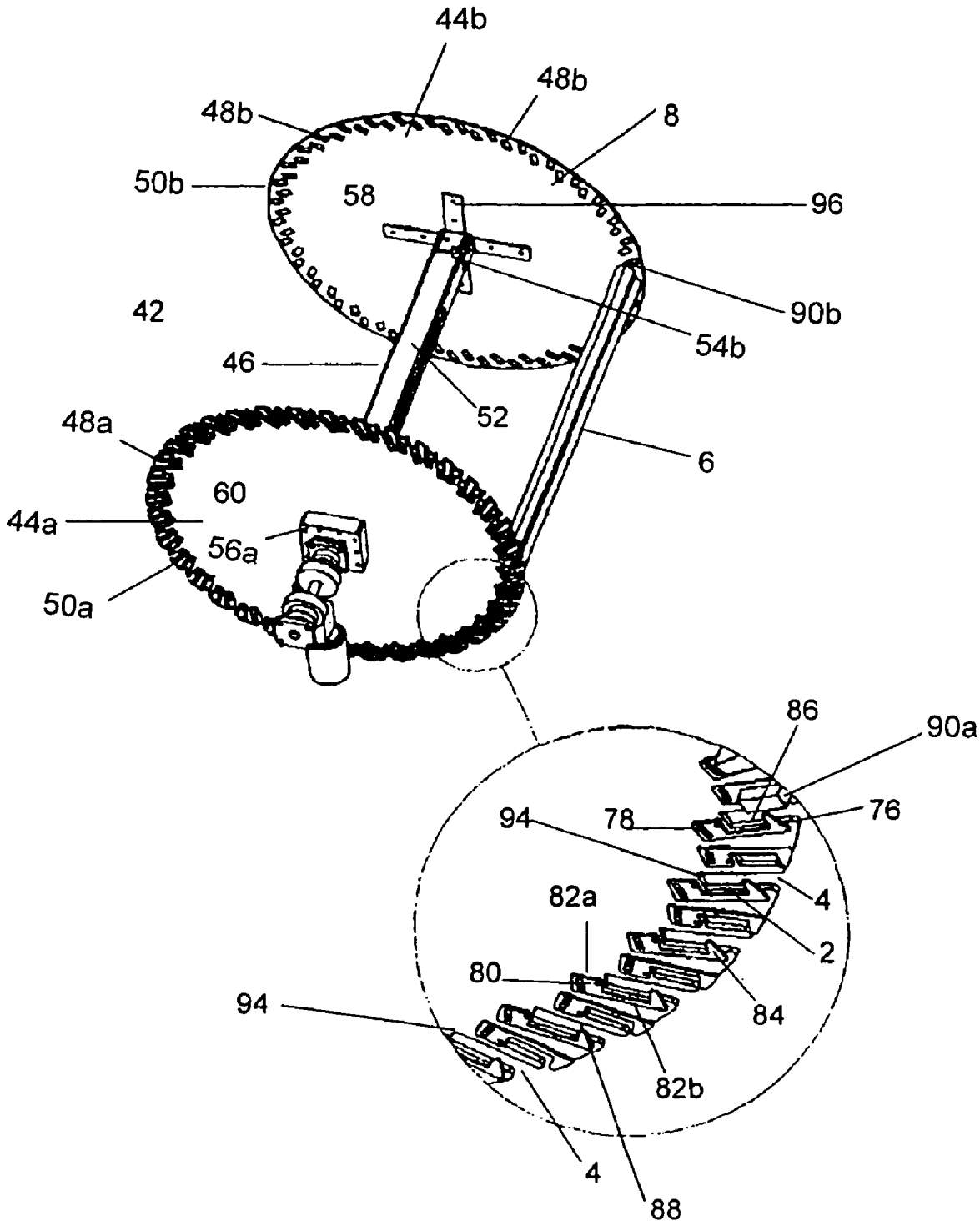
FIG. 8 is a side perspective of the fixture assembly, with an enlarged view of the slots on the first end disk.

In the preferred embodiment, one or both of the end disks 44*a*, 44*b* slidingly engage the shaft 46 to accommodate different length slats 6 or other items. Alternately, one or both end disks 44*a*, 44*b* may be fixed to the shaft 46. The shaft 46 preferably has flat sides 52, but may also have rounded sides. In the preferred embodiment, the shaft 46 comprises four flat sides that are approximately three inches in width each, and engages the end disk 44*a* by way of a recess block 56 that may be disposed on the inside face 58 of at least one of the end disks 44*a* or may be disposed in an opening in the end disk 44*a* to interface with the front and back face of the end disk 44*a*. One or both ends of the shaft 54*a*, 54*b* may sit in respective recess blocks 56 or similar structures, may protrude through the recess block 56, or they may fit through an opening in the disk 44*b* (not shown) to an outside face 60 of the end disk 44*b*. In an alternate embodiment, an opposite end of the shaft 54*b* may engage the opposite end disk 44*b* by way of a brace assembly 96 (FIG. 8). Alternately, the opposite end of the shaft 54*b* may engage the end disk 44*b* by other suitable means known in the art, such as welding, bolts brackets or adhesives.

In the preferred embodiment, at least one, and preferably a pair of seating elements 62 engages the outside face 60 of the disk 44*b* and one of the shaft ends 54 so that the fixture assembly 42 rotatably engages with a complementary receiving element 64 disposed on the tub 30 or on the housing 12.

The fixture assembly 42, when seated in the tub 30 or housing 12, is configured so that there is a space between the walls 68 of the tub 30 and the fixture assembly 42 to permit rotation of the fixture assembly 42, even when loaded with slats 6 or other items to be cleaned. When the fixture assembly 42 is removed from the housing 12 to load slats, the seating elements 62 may be fit onto the complementary receiving element 64 disposed on the housing 12 or tub 30 to seat the loaded fixture assembly 42 in the housing 12. Alternately, the fixture assembly 42 may be first seated into place in the housing 12 and the slats 6 or other items loaded one-by-one by rotating the fixture assembly 42 as more slats 6 are loaded. Once the operator has loaded the desired number of slats 6, the access port lid 66 or the housing cover 18 is closed and the unit is powered, preferably by actuating a power switch 11 on a control interface panel 13. The ultrasound unit 38, once powered, imparts ultrasound energy to cleaning liquid in the tub 30, and the fixture assembly 42 preferably rotates the slats 6 in the energized cleaning liquid. The slat washer 10 is preferably powered using 240 VAC, 3 phase power source, but may be powered by other suitable power sources. The slat washer 10 may be manually run, or can be configured to automatically rinse the slats 6 with an optional second rinse cycle using a sterile or purified liquid, such as USP water. In the preferred embodiment, cleaning liquid from wash and rinse cycles drains by gravity. The slat washer 10 may, however, include other suitable types of draining systems known in the art. The slat washer 10 may also include a drainage system comprising ball valves (not shown). The slats 6 may then be dried during a drying cycle. In the preferred embodiment, forced warm air is blown over the slats 6 from the warm air nozzles 68, while the fixture assembly 42 rotates. The forced air may be supplied to the slat washer by way of dryers that are disposed within an optional cabinet in the slat washer (not shown). The operator may then remove the cleaned and dried slats 6 or other items by opening the access port lid 66 or housing cover 18 and by singly removing each slat 6, or by removing the entire fixture assembly 42 from the slat washer 10. The invention allows the slats 6 or other items to be placed into, cleaned and withdrawn from the slat washer 10, without having to touch the cleaning solution.

While the present invention has been described with regards to particular embodiments, it is recognized that additional variations of the present invention may be devised without departing from the inventive concept.

What is claimed is:

1. An ultrasonic cleaner comprising:

a tub having a bottom and an open top for containing a liquid for cleaning;

an ultrasound unit, wherein the ultrasound unit engages the bottom of the tub;

a water unit for providing cleaning liquid and a rinse liquid to the tub; and a fixture assembly for holding items to be cleaned, wherein the fixture assembly is disposed within the tub, wherein the fixture assembly comprises a first end disk having a perimeter and a center axis and a second end disk having a perimeter and a center axis, and wherein the first end disk and the second end disk are spaced apart by a shaft engaging said end disks along said center axis and wherein the first and second end disks comprise a plurality of slots spaced along their respective perimeters, the slots of the first end disk being aligned respect to the slots of the second end disk.

2. The ultrasonic cleaner of claim 1 further comprising an airflow unit for directing air towards the fixture assembly.

3. The ultrasonic cleaner of claim 1, wherein the tub further comprises at least one pair of flanges disposed on at least two ends of the tub sides, wherein the flanges contact a portion of a support frame to support the tub.

4. The ultrasonic cleaner of claim 1, wherein the slots on the second end disk have closed sides to form closed slots.

5. The ultrasonic cleaner of claim 2, wherein the slots on the first end disk comprise an open side to form open slots.

6. The ultrasonic cleaner of claim 1, wherein the first and second end disks respectively comprised a pattern of alternating closed and open slots.

7. The ultrasonic cleaner of claim 6, wherein the closed slots on the first end disk align with open slots on the second end disk when the fixture assembly is configured to receive the items to be cleaned.

8. The ultrasonic cleaner of claim 1, wherein at least one of the slots comprises a hook element.

9. The ultrasonic cleaner of claim 8, wherein the hook element is disposed at an angle relative to the slot, and wherein the angle is towards the interior of the slot.

10. The ultrasonic cleaner of claim 1, wherein the slots are disposed on at least one of the first or second disks at an angle relative to the respective center axis of the first or second end disk.

11. The ultrasonic cleaner of claim 1, wherein items to be cleaned are slats used in slat counting devices for packaging a quantity of product into a container.

12. An ultrasonic cleaner for cleaning slats used in a slat counting device comprising:

a tub having a bottom and a top for containing a liquid for cleaning, an ultrasonic unit, wherein the ultrasonic unit engages the bottom of the tub;

a rinse water unit for providing cleaning liquid and a rinse liquid to the tub; and a fixture assembly for holding a plurality slats to be cleaned, wherein the fixture assembly is disposed within the tub, and wherein the fixture assembly comprises a first end disk having a perimeter and a center axis and a second end disk having a perimeter and a second axis, and wherein the first and second end disks are spaced apart by a shaft engaging said end disks along said center axis and wherein the first end disk and the second end disk comprise a plurality of slots along their respective perimeters the slots of the first end disk being aligned respect to the slots of the second end disk.

13. The ultrasonic cleaner for cleaning slats as claimed in claim 12, wherein the first end disk and the second end disk have a first locked position and a second locked position and wherein the first and second end disk move slidingly along the shaft in the second position to adjust the fixture assembly to accommodate slats of different lengths.

14. An ultrasonic cleaner for cleaning slats used in a slat counting device comprising:

a tub having a bottom and a top for containing a liquid for cleaning;

an ultrasonic unit, wherein the ultrasonic unit engages the bottom of the tub;

a rinse water unit for providing cleaning liquid and a rinse liquid to the tub; and a fixture assembly for holding a plurality slats to be cleaned, wherein the fixture assembly is disposed within the tub, and wherein the fixture assembly comprises a first end disk having a perimeter and a center axis and a second end disk having a perimeter and a second axis, and wherein the first and second end disks are spaced apart by a shaft engaging said end disks along said center axis and wherein the first end disk comprises slots having closed ends to form closed slots and wherein the second end disk comprises slots having open ends to form open slots.

15. The ultrasonic cleaner of claim 14, wherein the open slots further comprise a hook element and wherein a first end of the slat is seated into the closed slot on the first end disk and a second end of the slat is seated into the open slot and secured by the hook element.

* * * * *